United States Patent [19]

Sussman

[11] Patent Number: 4,691,841

[45] Date of Patent: Sep. 8, 1987

[54] CONTAINER FOR A PLASTIC TRASH BAG OR THE LIKE

[76] Inventor: Howard Sussman, 3101 NW. 25th Ave., Pompano Beach, Fla. 33069

[21] Appl. No.: 819,933

[22] Filed: Jan. 21, 1986

[51] Int. Cl.[4] ..... B65D 25/10

[52] U.S. Cl. ..... 220/404; 220/1 T; 141/390; 248/100

[58] Field of Search ..... 220/403, 404, 407, 1 T; 248/100, 99, 95; 141/316, 390

[56] References Cited

U.S. PATENT DOCUMENTS

| | | | |
|---|---|---|---|
| 1,455,536 | 5/1923 | Lebherz | 248/100 X |
| 1,714,308 | 5/1929 | Gunderson | 141/390 |
| 2,757,859 | 8/1956 | Holland | 220/1 T |
| 3,128,904 | 4/1964 | Reilly | 220/407 X |
| 3,130,853 | 4/1964 | Colthurst et al. | 248/100 X |
| 3,658,233 | 4/1972 | Voytko | 220/1 T X |
| 3,825,150 | 7/1974 | Taylor | 220/1 T X |
| 4,418,835 | 12/1983 | Watts | 220/404 |
| 4,444,355 | 4/1984 | Cary | 220/1 T X |
| 4,558,800 | 12/1985 | Isgar et al. | 220/1 T X |

*Primary Examiner*—Steven M. Pollard
*Attorney, Agent, or Firm*—Myron Amer

[57] ABSTRACT

A polygonal body is provided with a vane in each corner, having a pointed upper tip on which a flexible plastic bag may be fit. A cap in the form of an open frame of conforming polygonal shape covers the top of the body. The frame is provided with depending fingers between its corners. The fingers extend over the plastic bag to wedge the bag against the body walls.

5 Claims, 6 Drawing Figures

CONTAINER FOR A PLASTIC TRASH BAG OR THE LIKE

BACKGROUND OF THE INVENTION

The present invention relates to a trash receptacle and in particular to a container for use in homes especially in the bathroom.

Conventional containers for home use, particularly for bathroom and bedroom areas are generally, open topped parallelepiped structures of molded plastic or metal. With the advent of flexible plastic bags it has become common to line the container with such bags in order to keep the container itself cleaner and more easily facilitate its emptying. Generally, the flexible bag has been draped over the rim of the container and let hang loosely inside it. While in general, this is an improvement over the "nude" container, it still leaves much to be desired since the flexible bag has a tendency to be dislodged from the rim under the stress of successive trash disposals. In addition, the arrangement appears unsightly and not pleasing because of the ragged drape of the flexible bag over the container rim.

It is an object of the present invention to provide a decorative trash container for use in the home and in particularly in bathrooms, bedrooms, and other similar areas.

It is a further object of the present invention, to provide a decorative trash container having a liner which is easily installed within the container itself and has no portion visible from the outside.

It is another object of the present invention to provide a lined trash container wherein the liner will remain open through much use and disposal of various items and even when fully packed with trash.

These and other objects together with numerous advantages will be apparent from the following disclosure of the present invention.

SUMMARY OF THE INVENTION

According to the present invention, a trash container is provided having an open top, box-like body in which the side walls are arranged in polygonal cross section. A vane is located in each of the internal corners of the body and is provided with means at its upper end to ensnare a flexible bag along the edge of the bag. The container is also provided with a cap in the form of an open frame having a plurality of side walls arranged in conforming cross section to that of the body. The frame is adapted to fit interengageably over the top of the body and is provided with at least one finger depending downwardly along the interior surface of at least one of its side walls so as to extend below the lower edge of the frame and overlay the bag ensnared on the vanes. The combination of the fingers and vanes thereby act to hold the bag open in a substantial conforming cross section to that of the container body itself.

Preferably, each of the vanes comprises a flat, elongated member integrally formed with the body along a narrow edge of the vane. The flat member is cut at an angle extending downwardly and toward the surface of the body to form a point lying below the edge of the top of the body and comprising the means for ensnaring the bag.

The side walls of the cap frame is formed with a radially inward lip and a downwardly directed return from the lip along its upper edge and about its entire periphery. The lip and the return extend inwardly from the surface of the side walls to define an interior dimension of the frame at least equal to the cross section of the open bag as ensnared on said vanes. The fingers preferably formed with a downwardly and inwardly sloping edge forming a wedge adapted to push the open bag against the wall of the container body.

Full details of the present invention are set forth in the following description and illustrated in the accompanying drawings.

DESCRIPTION OF THE INVENTION

Figure 1:
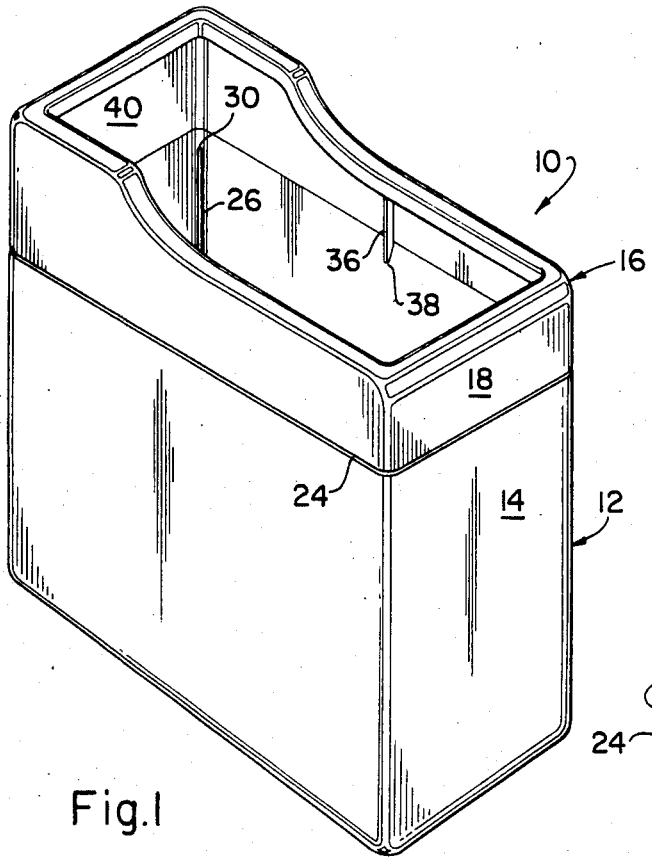
FIG. 1 is a perspective view of the trash container of the present invention.
Figure 5:
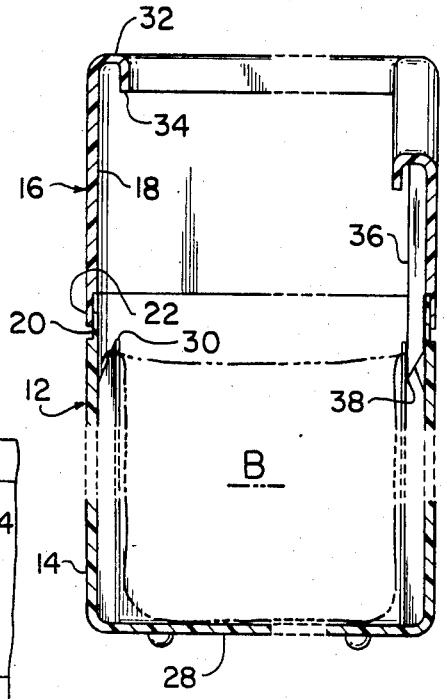
FIG. 5 is a sectional view taken along line 5—5 of FIG. 2.
Figure 6:
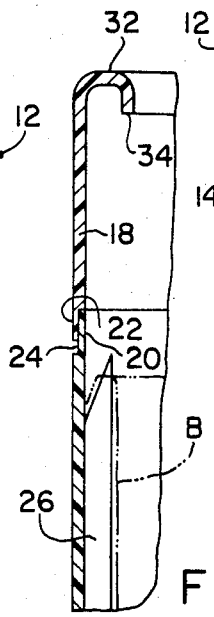
FIG. 6 is a sectional view taken along line 6—6 of FIG. 2.
Figure 2:
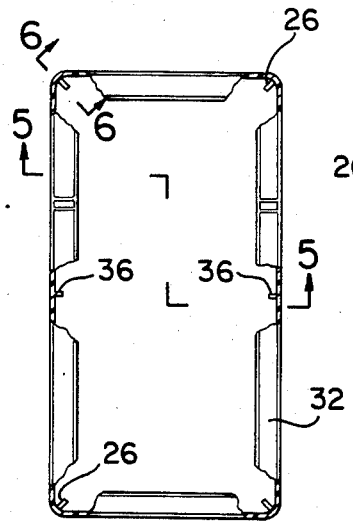
FIG. 2 is a plan view of the trash view of the container shown in FIG. 1 partially broken at its lips to show the vane's fingers.
Figure 3:
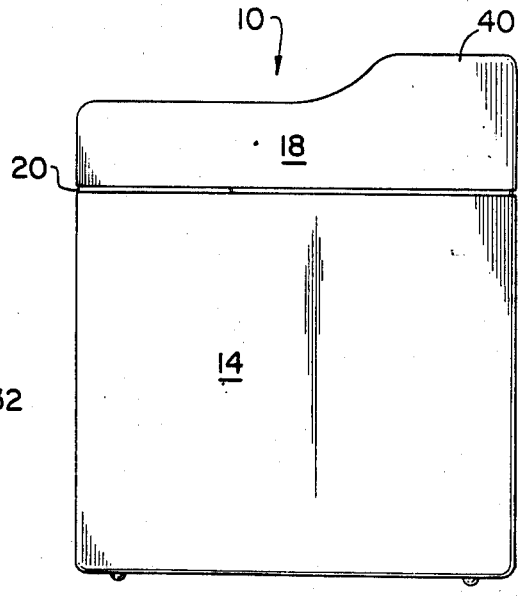
FIG. 3 is a side elevational view of the container shown in FIG. 1.
Figure 4:
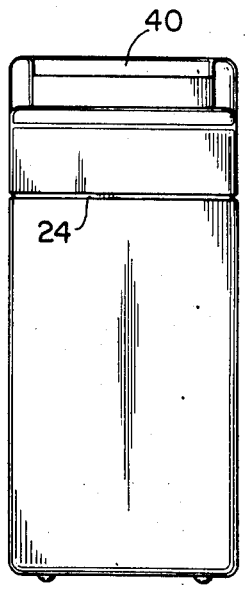
FIG. 4 is a front elevational view of the container of FIG. 1.

The trash container of the present invention is generally depicted in the drawings by the numeral 10. The container comprises a box-like lower body, generally depicted by the numeral 12 made up of a plurality of side walls 14 arranged in rectangular cross-section; and, an open cap frame generally depicted by the numeral 16, having a plurality of side walls 18 arranged in the conforming rectangular cross section to those of the lower body. The outer surface of the upper edge of the walls 14 of the lower body 12 is cut back as at 20, while the inner surface of the lower edge of each of the framed walls 18 is similarly cut back as at 22 to form an overlapping joint whereby the frame may be set upon the top of the box firmly and securely, yet is easily removable therefrom. The cut back 22 formed in the walls 18 of the cap frame 16 may be somewhat shorter than the corresponding cutback 20 formed in the lower body 12, thereby leaving a small open band 24 around the entire periphery of the container for decorative purposes.

Located in each of the inner corners of the lower body 12 is an elongated flat vane member 26. The vane member 26 is preferably integrally formed during the molding process of the container with the corner and extends from the bottom 28 of the body 12 to a point below the top edge of the body 12. The upper ends of each of the vanes 26 is cut back in a downward direction toward the inner surface of the body 12 so as to form a point 30 at its uppermost tip.

The walls 18 of the open frame 16 are formed along their upper edge with an inwardly directed lip 32 and a downwardly directed return 34. Depending along the inner surface of the frame 16 between the corners is a finger 36, which for the sake of convenience is a form similarly shaped to that of the vanes 26 in that it has a sloping tip 38 which slopes upwardly toward the surface of the wall 18. The finger 36 is of sufficient length that it depends below the lower edge of the frame so that when the frame is placed on the container body in overlapping relationship, the tip 38 terminates below the level of the point 30 on the vanes 26.

In use, a flexible plastic bag of any type which is readily and commercially available, is inserted within the lower body and ensnared over each of the points 30 at each of the corners. The open cap frame 12 is thereafter placed over the lower body 12 and the cut back portions 20 and 22 overlapped. When this occurs, the depending finger 36 passes over the top edge of the lower body engaging the side wall as well as engaging the inner surface of the plastic bag B pushing this plastic bag outwardly against the side wall of the inner body.

While the trash container has been described of being of rectangular cross section, it is apparent that other polygonal shapes can be employed. It is however the criteria of the present invention that the vanes 26 be located in each corner of the polygonal cross section and the fingers 36 be arranged in the frame along the side walls between the corners. In this way when the plastic bag is inserted into the lower body and ensnared over the points 30, it will generally assume the polygonal shape of the container body and when the frame 16 is thereafter placed over the lower body, the fingers 36 will insure that the portions of the bag B between the corners are held tightly and securely against the wall of the body thereby assuring the maintenance of the polygonal shape and the assurance that trash is prevented from lodging behind the bag, i.e. between the bag and the walls of the body itself.

The depending fingers 36 have another function in that it prevents the open cap frame from bowing or distoring with respect to the lower body once put in place. Therefore, it is preferable that the fingers 36 be applied on opposing walls in alignment with each other thereby maintaining symmetry. The depending fingers, however, need not be on all walls, since as will be obvious from the rectangular embodiment shown, the bag will be held sufficiently taut along the smaller side walls in contrast to the looser fitting along the longer side walls, and, therefore, at least the fingers should be along the longer walls.

The container may take various shapes and forms in addition to the cross sectional modification, already discussed. As seen in the embodiment shown, one of the shorter side walls 40 of the frame 16 is heightened so as to form more or less convenient backstop inhibiting trash from being thrown beyond the container.

While the lip and return of the cap frame have a basically decorative function, they also have a very significant mechanical function in that it narrows the opening of the frame so that the opening conforms more closely to the polygonal cross section of the plastic liner bag when ensnared over the supporting vanes. That is the return 34 is a spaced inwardly from the walls 18 of the frame substantially equal to the depth allotted to the vanes 26. Thus, when trash is thrown through the frame 18, its tendency is to fall directly into the bag B and not be caught on the points 30 of the supporting vanes 26.

Various modifications, changes, embodiments have been discussed, and others will be obvious to those skilled in this art. Accordingly, it is intended that the disclosure be taken as illustrative only and not as limiting of the invention.

What is claimed is:

1. The trash container comprising an open top box-like body having a plurality of side walls arranged in polygonal cross section, a vane located in each corner of said body having means at its upper end to ensnare a flexible bag and an open cap frame having a plurality of side walls arranged in a conforming cross section to that of said body and adapted to fit over the top of said body, said frame having a finger extending downwardly along at least one of its side walls below the lower edge thereof to overlay the edge of said bag ensnared on said vanes and to thereby hold said bag open in substantially conforming cross section to that of said body.

2. The trash container according to claim 1 wherein each of said vanes comprises a flat elongated member integrally formed with said body along a narrow edge of said member said flat member being cut at an angle extending downwardly and toward the surface of said body forming a point lying below of top of said body and comprising the means for ensnaring said bag.

3. The trash container according to claim 1 wherein the side walls of said frame have an inwardly directed lip and a downwardly directed return, said lip and return extending inwardly from said side walls of said frame a distance at least equal to the cross section of the open bag ensnared on said vanes.

4. The trash container according to claim 3 wherein said finger is formed with a downward and inwardly sloping edge to wedge said bag against said wall of said body.

5. The trash container according to claim 1 used in combination with a plastic liner bag.

* * * * *